United States Patent [19]

Stevens

[11] 4,332,990

[45] Jun. 1, 1982

[54] MINIATURE ILLUMINATED PUSH BUTTON SWITCH AND INDICATOR LIGHT

[75] Inventor: Curtis R. Stevens, Mission Viejo, Calif.

[73] Assignee: Master Specialties Co., Costa Mesa, Calif.

[21] Appl. No.: 151,160

[22] Filed: May 19, 1980

[51] Int. Cl.[3] ..... H01H 9/16; G08B 5/00

[52] U.S. Cl. ..... 200/314; 340/366 G

[58] Field of Search ..... 200/310, 311, 312, 313, 200/314, 153 J; 362/253, 85, 95; 340/366 G

[56] References Cited

U.S. PATENT DOCUMENTS

| | | | |
|---|---|---|---|
| 3,157,771 | 11/1964 | Roeser | 200/314 |
| 3,315,535 | 4/1967 | Stevens | 200/153 J |
| 3,402,379 | 9/1968 | Amis et al. | 200/153 J |
| 3,522,403 | 8/1970 | Fuller | 200/314 |
| 3,773,999 | 11/1973 | Groezinger | 200/314 |
| 3,947,651 | 3/1976 | Fuller | 200/314 |
| 3,988,557 | 10/1976 | Francke et al. | 200/314 |

*Primary Examiner*—John W. Shepperd
*Attorney, Agent, or Firm*—Christie, Parker & Hale

[57] ABSTRACT

A miniature illuminated push button switch includes a push button capsule mounted in a housing containing a switch assembly. The capsule contains a plurality of lamps for illuminating the face of the push button. The push button can be depressed into the housing for actuating the switch assembly, which includes a pair of sub-miniature switches mounted below a corresponding pair of spring biased plungers projecting from the capsule. The lamp contacts make contact with corresponding conductive volute spring contacts inside the housing. The spring biased plungers are pushed into contact with the switch contacts when the push button is depressed. The capsule can be removed from the housing, say for relamping, by pulling the capsule out of the housing to detach the capsule from the latch. An alternate action cam assembly latches the push button in a depressed position for holding the switch contacts closed on alternate actuations of the push button.

23 Claims, 13 Drawing Figures

MINIATURE ILLUMINATED PUSH BUTTON SWITCH AND INDICATOR LIGHT

FIELD OF THE INVENTION

This invention relates generally to electro-mechanical switches and indicator lights, and more particularly, to an illuminated push button switch and indicator light of miniature size and reduced weight principally adapted for avionics use.

BACKGROUND OF THE INVENTION

Push button switches are well known in which a push button projects from the front of a housing, and a switch inside the housing is actuated by depressing the push button. The push botton can be illuminated from the rear by lamps mounted behind the face of the push button.

This type of push button switch has numerous avionics uses, such as in navigational systems generally, and more specifically in radar systems and airborne electronic systems controls. In many avionics uses, there is an urgent need to reduce the size and weight of these switches as much as possible. For example, in fighter planes the current cost of added weight is approximately $88,000.00 per pound, and size reduction carries a similar premium. The miniature size and intricate arrangement of component parts in such avionics switches require a switch assembly designed to ensure long-term reliability.

Such avionics uses also dictate the need to quickly and easily gain access either to the switch mechanism or to the lamps for maintenance or relamping purposes. The miniature size and intricate arrangement of the switch assembly can make relamping or maintenance difficult.

To permit the push button to be removed from its housing without tools of any sort, the push button may be secured to the rest of the switch mechanism by frictional engagement with a suitable detent mechanism which allows the push button to be withdrawn by pulling strongly on the projecting portion of the push button. After relamping or other maintenance is completed, the push button is replaced by pushing it back into position in the housing. There is a need to facilitate such removal of the push button, for relamping or other maintenance to the switch assembly, and proper replacement of the push button with a minimum of time or error.

Indicator lights also have numerous avionics uses requiring reduced size and weight, long term reliability and ease of maintenance and relamping.

SUMMARY OF THE INVENTION

One embodiment of this invention is directed to a miniature illuminated push button switch assembly principally for avionics uses. The switch assembly includes a push button that can be depressed for actuating a switching mechanism. The push button can be illuminated by lamps mounted behind the face of the push button.

Briefly, the push button switch includes a housing, a push button projecting from the housing, a switch contact in the housing, a switch actuator on the push button inside the housing, a lamp receptacle on the push button for use in illuminating the push button via a lamp disposed in the lamp receptacle, and a conductive volute spring in the housing adjacent the lamp receptacle.

The push button is movably supported in the housing so the switch actuator is aligned with the volute spring. The push button is movable into the housing for causing the switch actuator to actuate the switch contact. The push button can be releasably latched in its depressed position for retaining the switch contact actuated until the push button is depressed a second time.

The switch assembly of this invention facilitates miniaturization to the extent that a plurality of sub-miniature switches and lamps, with their electrical contacts, can be contained in the same miniature housing in an arrangement that facilitates ease of maintenance and reliability of operation. In one embodiment, the avionics switch of this invention weighs only ½ ounce and occupies only about one cubic inch, making it particularly suitable for avionics uses having large weight and size premiums.

The push button can be releasably supported for movement in the housing by a mechanism for detaching the push button from a support by pulling the push button away from the housing and for reattaching the push button to the support by pushing the push button back into the housing. A flexible and foldable hinge extends from a fixed point inside the housing to the push button to maintain the push button captive when the push button is detached from the support. This embodiment facilitates quickly and easily removing the push button, relamping or other maintenance, and then accurately replacing the push button.

Another embodiment of the invention comprises an indicator light which includes a housing, a capsule releasably latched to the front of the housing, a lamp receptacle in the capsule for use in illuminating a face of the capsule via a lamp disposed in the receptacle, and a conductive volute spring in the housing in contact with a contact of a lamp disposed in the lamp receptacle. As in the switch assembly, the indicator light capsule can be releasably latched in the housing and a flexible and foldable linge can maintain the capsule captive when removed from the housing.

These and other aspects of the invention will be more fully understood by referring to the detailed description and the accompanying drawings.

DRAWINGS

DETAILED DESCRIPTION

Figure 1:
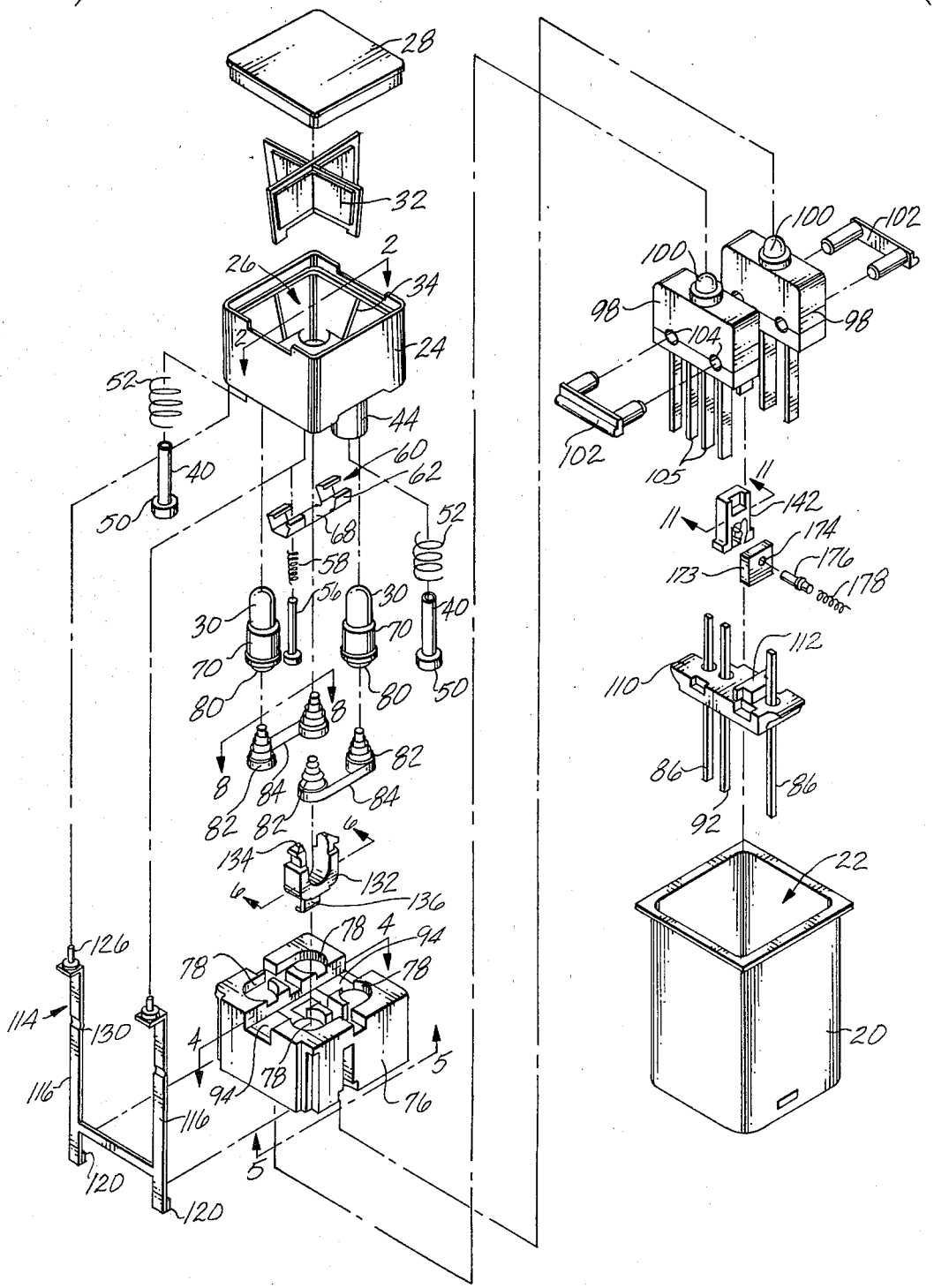
FIG. 1 is an exploded perspective view showing components of a switch assembly according to principles of this invention.

The exploded view of FIG. 1 shows components of a push button switch assembly according to principles of this invention. The switch assembly includes an outer housing 20 having an upwardly facing top opening 22 and a hollow interior. The housing is made of a material such as hard plastic or metal. A push button is movably supported in the top opening of the housing. The push button includes a generally cup-shaped push button capsule or lamp capsule 24 having an upwardly facing top opening 26. The body of the push button capsule is made of a non-electrically-conductive material such as hard plastic. The push button has a screen or lens 28 with a suitable legend illuminated by one or more lamps 30 releasably mounted inside the capsule. The lens releasably snap locks into engagement with the top of the capsule. The bottom of the lens carries a legend divider 32 that fits into grooves 34 inside the capsule. The divider is shown as four-sided, although two or three-sided dividers also can be used. The exterior of the lamp capsule is shaped to make a snug sliding fit inside the upper interior portion of the housing 20. In one embodiment, not shown, a sealed capsule can be provided by securing a square ring seal around the exterior of the capsule for providing a sealed contact between the capsule and the interior of the housing.

Figure 2:
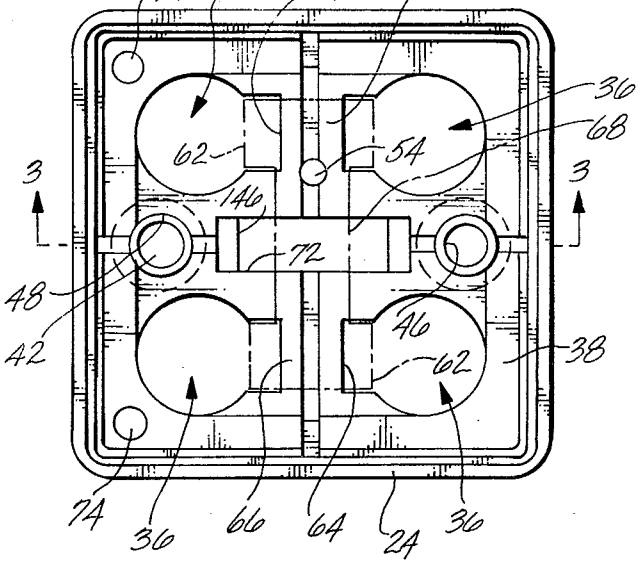
FIG. 2 is a top plan view of a lamp capsule taken on line 2—2 of FIG. 1.
Figure 3:
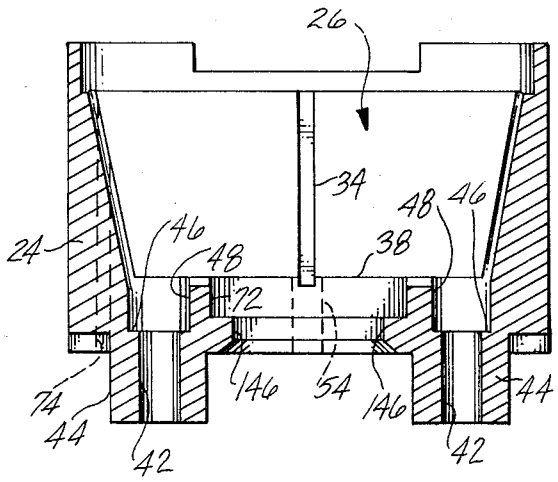
FIG. 3 is a cross-sectional view taken on line 3—3 of FIG. 2.

More detailed construction of the push button capsule is understood best by referring to FIGS. 2 and 3. The interior of the capsule is adapted to mount four of the lamps 30. The lamps are mounted in separate lamp receptacles 36 formed as openings generally near the four corners of a base 38 of the capsule. A pair of switch-actuating plungers 40 (see FIGS. 1 and 12) project down from the underside of the push button capsule. Each plunger is retained in a passage 42 extending through a corresponding cylindrical projection 44 projecting down from the underside of the capsule. The top of each plunger has a flange that bears against an annular wall 46 below an oversized recess 48 above each passage 42. The plungers project down from the underside of the cylindrical projections on the capsule. Each plunger has a lower flange 50 that retains a separate coil spring 52 (see FIGS. 1 and 12) for spring biasing the plungers away from the bottoms of the projections. The coil springs are compressed by movement of the plungers toward the capsule.

A small passage 54 through the base of the push button capsule retains a conductive ground contact 56 (see FIGS. 1 and 12) in the form of a narrow filament-like plunger. The ground contact extends from the interior of the capsule through the passage 54 and projects below the undersurface of the capsule. A flange on the bottom of the ground contact retains a coil spring 58 (see FIGS. 1 and 12) for spring biasing the ground contact away from the underside of the capsule. The ground contact is movable toward the underside of the capsule against the bias of the coil spring.

A conductive bus bar 60 (shown in solid lines in FIGS. 1 and 12) is snap locked into engagement with the base of the capsule. The bus bar has a separate pair of flanges 62 at each end for extending into corresponding extensions 64 of the lamp receptacles and snap locking into an engagement with a separate bridge 66 between each adjacent pair of receptacle extensions. The main body 68 (shown in phantom lines in FIG. 2) of the bus bar extends across the bottom of the capsule, and the ground contact 56 is an electrical contact with the main body of the bus bar. Each flange of the bus bar makes electrical contact with a contact 70 of a corresponding lamp when the lamps are inserted in the receptacles.

An elongated slot 72 extends through the base of the capsule between the passages 42. The slot provides a detent for latching the push button inside the housing in a manner described in detail below.

A pair of narrow passages 74 extend through corner portions of the capsule base. These passages open through the underside of the capsule and provide means for securing a flexible hinge to the push button in the manner described below.

Figure 4:
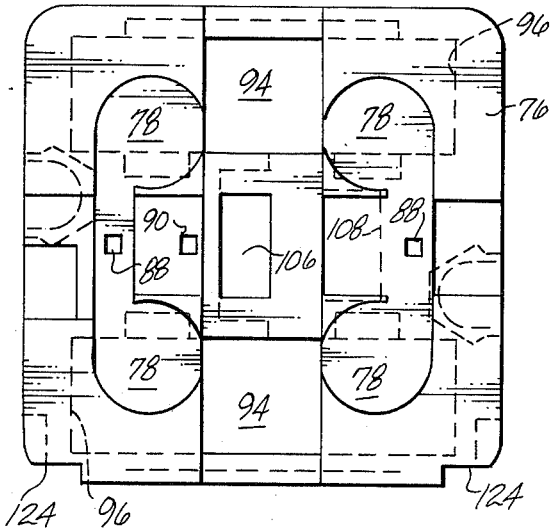
FIG. 4 is a top plan view of a switch mounting base taken on line 4—4 of FIG. 1.
Figure 5:
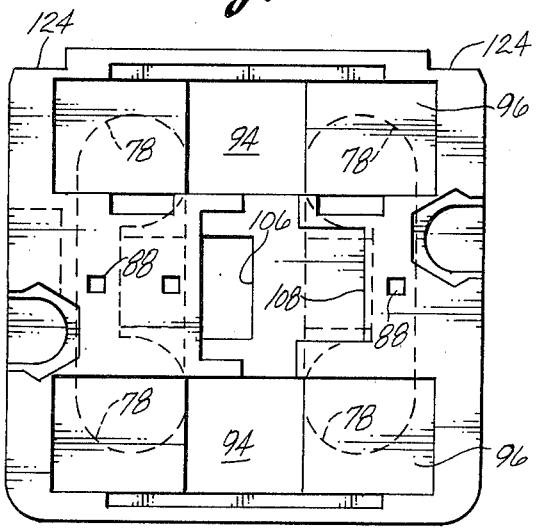
FIG. 5 is a bottom view of the switch mounting base taken on line 5—5 of FIG. 1.
Figure 6:
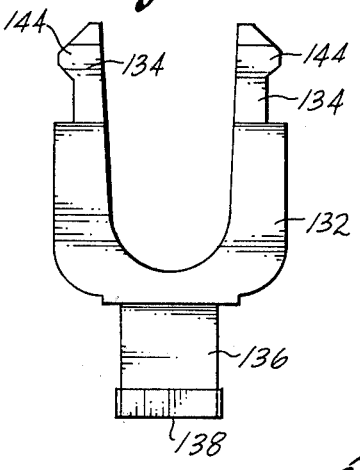
FIG. 6 is a front elevation view of a push button latch taken on line 6—6 of FIG. 1.
Figure 7:
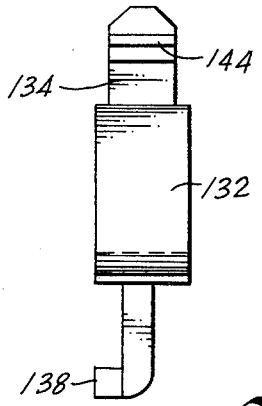
FIG. 7 is a side elevation view taken on line 7—7 of FIG. 6.

A switch mounting base 76 is secured inside the bottom portion of the housing. The body of the base is made of a non-electrically-conductive material, such as hard plastic. Detailed construction of the base is understood best by referring to FIGS. 4 and 5. The upper surface of the base includes four rounded recesses 78 arranged on a square pattern. The recesses are aligned below electrical contacts 80 on the bottoms of the lamps inserted in the lamp receptacles of the push button capsule. The recesses provide a means of support for separate conductive volute springs 82. The volute springs, in use, are maintained in constant spring-biased contact with the lamp contacts 80. Each volute spring comprises a tapered coil spring made of spring metal and arranged as a spiral with the taper being narrower in a direction away from the base 76 and toward the push button capsule. Each volute spring can be compressed into essentially flat form by a compressive force acting downwardly along the central axis of the spring. When the force is released the spring expands vertically to its normal extended position shown in the drawings.

Figure 8:
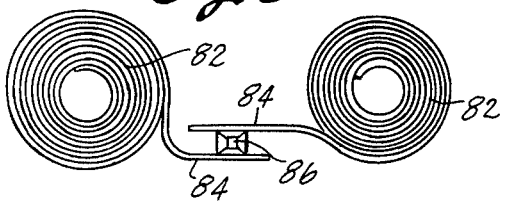
FIG. 8 is a top plan view of a pair of volute springs taken on line 8—8 of FIG. 1.

The volute springs are electrically connected in pairs. As shown best in FIG. 8, each pair of adjacent volute springs have extensions 84 extending toward one another, and these extensions are secured to a corresponding conductive terminal 86. A separate passage 88 extends through the portion of the base that bridges the pair of recesses 78 for each connected pair of volute springs. The terminal 86 for each connected pair of volute springs extends through the passage 88 and projects below the base 76.

A passage 90 extends through the base adjacent one of the passages 88. A ground contact terminal 92 is disposed in the passage 90. The ground contact terminal projects above the base a sufficient distance to make contact with the spring biased ground contact 56 when the push button is engaged in the housing.

Separate switch contact passages 94 extend through corresponding portions of the base that bridge adjacent pairs of volute spring recesses associated with the pairs of volute springs that are not connected. The switch contact passages 94 open into upper central portions of narrow elongated slots 96 formed in the underside of the base and extending along opposite sides of the base. Each slot 96 houses the body of a separate sub-miniature switch 98 shown best in FIG. 1. Each sub-miniature switch is preferably the type that is actuated by a push button 100 that can be depressed by a pushing force and automatically released when the force is removed. The switch is an on/off type switch that alternately makes and breaks electrical contact when the push button contact is depressed and released. A preferred sub-miniature switch is switch SB3-10034, manufactured by Otto Controls.

Each sub-miniature switch is mounted in a corresponding slot so that the push button contact 100 projects through a corresponding passage 94 above the upper surface of the switch mounting base, i.e., each push button faces the underside of the push button capsule when the capsule is positioned in the housing. In this position, each switch contact 100 is aligned with a corresponding switch-actuating plunger 40. A separate generally U-shaped switch pin 102 fits into a pair of holes 104 in the body of the switch to provide means for frictionally securing the switch in the switch mounting base. Each switch has four terminals 105 that project down from the underside of the base.

A slotted opening 106 in the upper central portion of the switch mounting base 76 opens into the upper portion of a slot 108 formed in the underside of the base between the two slots 96 which house the sub-miniature switches. A non-conductive terminal board 110 (see FIG. 1) overlies the bottom of the slot 108 and extends between and generally parallel to the two subminiature switches. The terminal board has holes to accommodate passage of the terminals 86 from the volute springs and the ground contact terminal 92. The upper surface of the terminal board includes a block 112 that projects into the interior of the slot 108, specifically a portion of the slot 108 that is offset from the upper passage 106. With the terminal board in place in the bottom of the base, the slot 108 provides a hollow interior region for mounting an alternate action cam assembly described in detail below.

Figure 9:
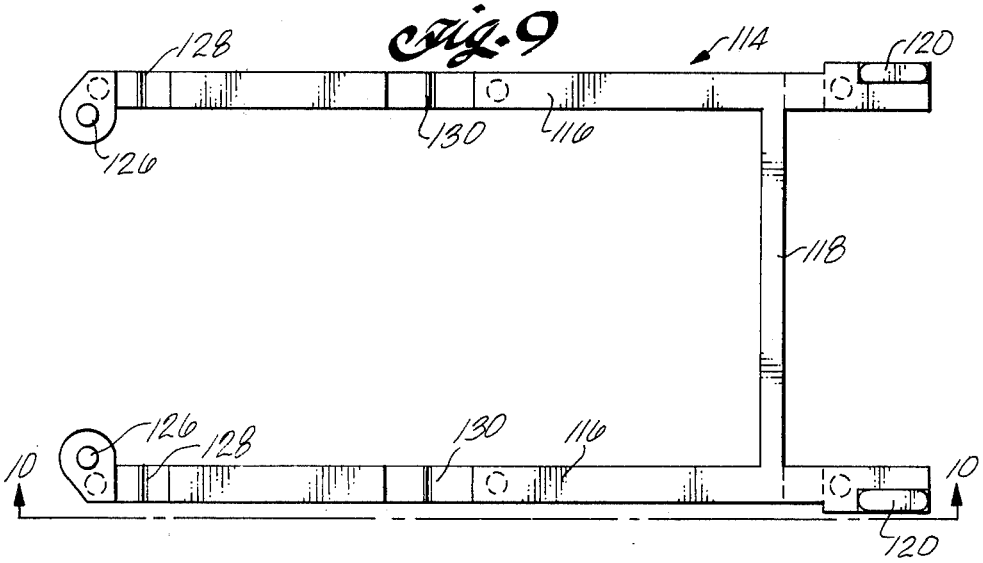
FIG. 9 is an elevation view of a flexible hinge.
Figure 10:
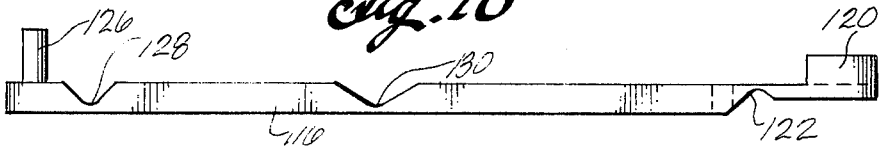
FIG. 10 is a side elevation view taken on line 10—10 of FIG. 9.

A flexible and foldable hinge 114 (shown in FIGS. 1, 9 and 10) is secured at one end to the underside of the base 76 and is secured at its opposite end to the underside of the push button capsule 24. The hinge is generally H-shaped and is made of a non-electrically-conductive material, such as a flexible plastic. Referring to FIGS. 9 and 10, the hinge generally includes a pair of elongated flexible legs 116 attached by a cross-piece 118. A pair of projections 120 at the ends of the legs are bonded to the underside of the switch mounting base, along with the cross-piece 118. A lower living hinge 122 facilitates bending of the legs at a right angle around the lower corners of the base. The lower portions of the legs pass through corresponding slots 124 extending upwardly along the corners of the base. This provides passage for the legs of the hinge when the base is mounted inside the housing. The upper portions of the legs extend away from the upper surface of the base to the underside of the push button capsule, where a pair of projections 126 at the upper ends of the legs are inserted in and bonded to the holes 74 in the underside of the capsule. An upper living hinge 128 on each leg facilitates bending of the hinge relative to the capsule. An intermediate living hinge 130 on each leg facilitates folding of the hinge inside the housing when the push button is in position in the housing. The hinge maintains the push button capsule captive when the push button is removed from the housing, as described in greater detail below.

The push button capsule is movably supported in the upper portion of the housing by a latch in the form of a yoke 132 (see FIGS. 1, 6, 7 and 12) which opens upwardly and extends above the upper surface of the switch mounting base 76. A pair of prongs 134 at the top of the yoke are inserted in detents formed by the slotted opening 72 on opposite sides of the bus bar 68 for releasably snap locking the push button into engagement with the yoke. More specifically, outward projections 144 on the prongs at the top of the yoke releasably snap lock into engagement with a pair of ridges 146 (see FIGS. 2 and 3) on opposite sides of the slot 72 in the push button capsule. This means of attachment enables the push button to be pulled loose from the housing by pulling the push button away from the housing to detach it from the yoke. The push button capsule can be reattached in the housing by pushing the capsule into the housing to snap lock the prongs of the yoke into engagement with the detent on the bottom of the capsule.

Figure 11:
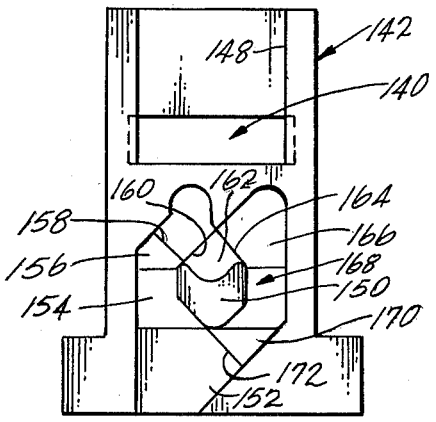
FIG. 11 is a front elevation view of an alternate action cam taken on line 11—11 of FIG. 1.

A leg 136 at the bottom of the yoke extends through the opening 106 in the top of the switch mounting base 76 and projects into the hollow interior region inside the slot 108 formed in the bottom of the base above the terminal board 110. A detent 138 at the bottom of the leg 136 interlocks with a slotted opening 140 in an upper portion of an alternate action cam 142 (shown in FIGS. 1 and 11). The alternate action cam is disposed in the hollow central interior region of the switch mounting base. The leg at the bottom of the yoke fits into a groove 148 formed in the upper portion of the alternate action cam above the opening 140. Preferably, the interlocking portions of the yoke and cam are heat-welded to each other.

The lower portion of the alternate action cam includes a generally U-shaped stop 150 that projects outwardly and is surrounded by a cam groove that includes (going clockwise around the stop) a floor 152 with an upwardly inclined first ramp 154 that terminates in a flat elevated cam surface 156 that drops down at a first step 158. A flat cam surface adjacent the first step drops down at a second step 160 which forms a flat first depression 162 above the U of the stop 150. This drops down at a third step 164 to form a flat second depression 166 which then merges into an upwardly inclined second ram 168. The ramp terminates at a flat elevated surface 170 which then drops down over a fourth step 172 to the floor 152.

The alternate action cam and the yoke move up and down vertically as a unit as the push button is pushed down and then released, respectively. The alternate action cam is engaged with an assembly which includes a slide 173 (see FIG. 1) in the form of a block having an opening 174 near its top. A cam follower pin 176 is affixed in the opening of the slide and a coil spring 178 biases the slide and the pin toward the cam so the pin travels in the cam groove of the cam. Owing to the spring biased horizontal movement of the slide toward the cam, the pin travels around the cam groove and makes contact with the various cam surfaces of the groove. Travel of the pin in the cam groove is controlled by upward and downward movement of the cam, in response to corresponding upward and downward movement of the push button. The slide maintains the pin in alignment with the cam groove, and the fixed block 112 on the terminal board 110 is positioned behind the slide for maintaining the slide in proper alignment with the cam. The pin engages the vertical side edge of the U-shaped stop 150 in the center of the cam groove and travels clockwise around the side edge of the stop.

When the push button is depressed for turning the switches to the "on" position, the alternate action cam moves downwardly, causing the pin to travel upwardly and in a clockwise direction in the cam groove. The pin travels up the first ramp 154 and then down the first step 158 and into the depression 162 above the U of the stop 150. The pin at this point backs up shortly after the push button force is released, moving to the U of the stop where the pin is retained and prevented from travelling backwards over the second step 160. This latches the push button in its depressed position so the switches stay in their "on" position, even after the actuating force on the push button has been released. The pin being locked in the U keeps the switches depressed until the next time the push button is depressed, which then moves the cam upwardly in a clockwise direction in the cam groove away from the U and into the second depression 166 and then up the second ramp 168 and over the fourth step 172 to the "home" position of the pin. Thus, by depressing and releasing the push button twice in sequence, the switches are alternately turned on and latched in the on position and then turned off and kept in the off position.

Figure 12:
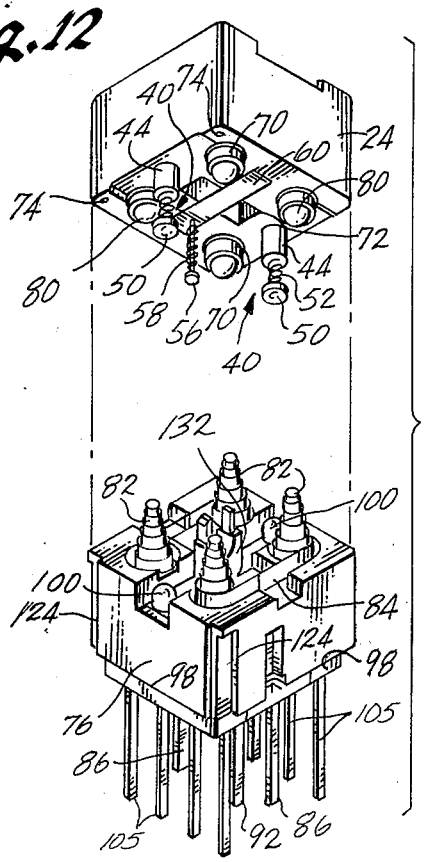
FIG. 12 is an exploded perspective view showing a partially assembled arrangement of the switch assembly.

The switch assembly is assembled by securing the switch mounting base 76 in the bottom of the housing 20. The bottom of the housing has an opening through which the terminal pins 86, 92 and 104 can project. The switch mounting base can be adapted to snap lock into engagement with the bottom of the housing for retaining the sub-miniature switches and the terminal board in the bottom of the housing. The switch assembly is assembled as shown in FIG. 12 with the plungers 40 aligned vertically above the switch contacts 100 and the lamp contacts 80 in contact with corresponding volute springs 82. The push button capsule 24 is supported in a fixed position in the housing by snap locking the yoke 132 into the slot 72 at the base of the push button capsule. This is done by simply pushing the capsule down into the housing. The plungers 40 are normally in a position that allows the push button contacts on the sub-miniature switches to remain in their normal unactuated position. There is constant electrical contact between the lamp contacts and the volute springs whether the switch is in the actuated or unactuated position. This provides means for illuminating the lamps in the push button capsule to provide back lighting for any legend on the face of the push button. The lamps can be illuminated at any desired time by completing a circuit external to the switch for supplying current to the lamps. When the push button is depressed the plungers push down on the switch contacts to turn the switches to their "on" position. As the push button is depressed for turning the switches to the "on" position, the alternate action cam moves down, which causes the cam follower pin to travel up in the cam groove and latch the switch contacts in the "on" position. When the push button is depressed next, the alternate action again moves down which moves the cam follower pin away from its latching position so that when pressure on the push button is released, the switches can move to and stay in the off position.

The push button can be removed from the housing to replace the lamps, change the legend on the screen, or to provide access to the components in the interior of the housing. The push button can be removed from the switch assembly by pulling the push button out of the housing to unlatch the push button capsule from the yoke. The flexible hinge 114 which normally remains folded inside the housing extends outwardly with the push button capsule to maintain the push button capsule captive when the capsule is removed from the housing. This ensures that the capsule will not be lost and that the capsule is properly positioned when replacing it in the housing. The push button is then reattached by pushing it back into the housing for snap locking it into engagement with the yoke. The flexible hinge folds in a controlled manner inside the housing when the push button capsule is replaced. The cross-piece 118 of the hinge holds the opposite legs of the hinge apart so the legs of the hinge are properly positioned along the sides of the housing when folded into the housing; and prevents the hinge from interfering with the lamp contacts when the push button is in place in the housing. The hinges 130 on the legs of the hinge allow the legs of the flexible hinge to fold back on themselves when the capsule is in place. This allows the legs of the hinge to extend along opposite sides of the housing.

The invention facilitates providing a push-button operated switch assembly comprising a plurality of push button operated switches together with electrical components for illuminating the face of the push button in a sub-miniaturized configuration. The switch mounting base effectively mounts the switch contacts, the yoke, and the alternate action cam below the movable push button, together with supporting the volute spring contacts below the lamp contacts in an arrangement that saves space and weight. The volute spring contacts are particularly useful in saving space and providing a reliable and constant spring biased contact with the lamp contacts. They are effective in taking up the travel of the push button and any tolerances of the lamps. Moreover, the arrangement of spring biased switch-actuating cams and the volute spring contacts add to reliability in reducing to a minimum the number of moving parts or joints between components of the switch assembly.

Figure 13:
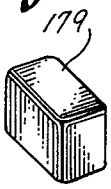
FIG. 13 is a perspective view showing an indicator stop used in converting the switch assembly to an indicator light.

The switch assembly described above can be converted to a miniature indicator light. In this instance the sub-miniature switches 98 can be removed from the housing and the lamp capsule 24 can be fixed in a stationary position in the front of the housing. A stop element 179 shown in FIG. 13 can be inserted into the alternate action cam assembly to stop the upward and downward travel of the cam 142 adjacent to the block 112 on the terminal board 110. This keeps the cam from moving down and prevents the capsule from being depressed into the housing when pressure is applied to the face of the capsule. Otherwise, the indicator light has the same construction as the switch described above. The volute springs make continuous contace with the contacts of the lamps in the fixed lamp capsule, and the lamp capsule is releasably latched in the front of the housing through its connection to the yoke 132. The indicator light can be used in various avionics applications such as control panel warning lights and the like.

What is claimed is:

1. A push button switch assembly comprising:

a housing;

a push button projecting from the housing;

switch means in the housing;

a switch actuator on the push button inside the housing;

a plurality of lamp receptacles in the push button for receiving lamps for illuminating the push button;

a plurality of conductive volute springs in the housing adjacent the lamp receptacle, each volute spring having an axis along which it can be compressed;

means movably supporting the push button in the housing to align the switch actuator with the switch means to operate the switch means and to align a contact of a lamp in each lamp receptacle with the axis of a volute spring, each lamp contact being in spring-biased contact with a spring, the push button being movable into the housing for moving the switch actuator to actuate the switch means; and a base inside the housing below the push button, means on the base for supporting the volute springs below the lamp receptacles, and means securing the switch means to the base inside the housing below the switch actuator.

2. Apparatus according to claim 1 in which the switch actuator comprises a plunger projecting from the underside of the push button into the housing toward the switch means.

3. Apparatus according to claim 2 including means spring biasing the plunger away from the underside of the push button, the spring biasing means being compressed when the push button is depressed to push the plunger against the switch contact.

4. Apparatus according to claim 2 including latching means in the housing for releasably securing the push button to a base in the housing, the latching means being detachable between the push button and the base by pulling the push button away from the housing and reattached by pushing the push button back into the housing.

5. Apparatus according to claim 4 in which the latching means comprises a yoke in the housing for snap locking into engagement with the underside of the push button.

6. Apparatus according to claim 1 including a plurality of said switch means, each respective switch means being positioned between a separate pair of adjacent volute springs; and including a separate switch actuator on the push button aligned with each switch means.

7. Apparatus according to claim 6 in which each switch actuator comprises a separate plunger projecting from the underside of the push button, between a pair of adjacent lamp receptacles, into the housing toward each switch contact.

8. Apparatus according to claim 7 including means spring biasing each plunger away from the underside of the push button, the spring biasing means being compressed when the push button is depressed to push each plunger into contact with a corresponding switch means.

9. Apparatus according to claim 7 including latching means in the housing for releasably securing the push button to the base, the latching means being detachable between the push button and the base by pulling the push button away from the housing and rettached by pushing the push button back into the housing.

10. Apparatus according to claim 9 in which the latching means comprises a yoke in the housing for snap locking into engagement with the underside of the push button.

11. Apparatus according to claim 9 in which the latching means is movable in response to movement of the push button; and including a cam movable in response to corresponding movement of the latching means, and cam follower means for engaging the cam to releasably retain the push button in a depressed position with the switch actuator engaged with the switch means.

12. Apparatus according to claim 1 including latching means in the housing for releasably securing the push button to a base of support in the housing, the latching means being detachable between the push button and the base of support by pulling the push button away from the housing and reattaching by pushing the push button back into the housing.

13. Apparatus according to claim 12 in which the latching means is movable in response to movement of the push button; and including a cam movable in response to corresponding movement of the latching means, and cam follower means for engaging the cam to releasably retain the push button in a depressed position with the switch actuator engaged with the switch contact.

14. Apparatus according to claim 12 in which the latching means comprises a yoke in the housing for snap locking into engagement with the underside of the push button.

15. A push button switch assembly, comprising:

a housing;

a push button capsule in the upper interior of the housing;

a plurality of switch actuators carried on the underside of the push button;

a switch mounting base inside the housing below the push button capsule;

a plurality of switches disposed in corresponding receptacles in the base for facing a separate switch contact of the switch toward a corresponding switch actuator;

a plurality of lamp receptacles in the push button capsule for receiving lamps each having a contact that faces the switch mounting base;

a plurality of volute springs disposed in corresponding volute spring holders in an upper face of the base for aligning the axes of the volute springs with lamp contacts of lamps disposed in corresponding lamp receptacles to hold the volute springs in spring-biased contact with the lamp contacts;

latching means secured to the base and releasably engaged with the push button capsule, the latching means being movable into an interior region of the base in response to movement of the push button capsule into the housing; and cam means in said interior region of the base operative in response to movement of the latching means for releasably retaining the push button in a depressed position with the switch actuators engaged with the switch contacts.

16. Apparatus according to claim 15 including flexible hinge means securing the capsule to the base.

17. An indicator light assembly comprising:

a housing;

a lamp capsule in the housing;

a lamp receptacle in the capsule for releasably mounting a lamp in the capsule;

means in the housing providing electrical contact with a contact on a lamp mounted in the lamp receptacle;

means releasably supporting the lamp capsule in the housing, including means for detaching the capsule from the means releasably supporting the lamp capsule by pulling the capsule away from the housing and for reattaching the capsule by pushing the capsule back into the housing; and flexible hinge means extending from the inside of the housing to the capsule for maintaining the capsule captive when the capsule is detached from the support means, the hinge means including at least a pair of spaced apart, elongated flexible and foldable filament-like members extending from opposite sides of the capsule to opposite sides of a fixed base of support inside the housing.

18. Apparatus according to claim 17 in which the hinge means is a flexible and foldable member of sufficient length for permitting the capsule to be removed entirely from the housing.

19. Apparatus according to claim 17 in which the capsule has an underside facing the interior of the housing, and the lamp receptacle is on the underside of the capsule for releasably mounting a lamp in the receptacle via access from the underside of the push button.

20. Apparatus according to claim 17 in which the hinge means includes an elongated cross-piece between said filament-like members.

21. Apparatus according to claim 17 in which the opposite filament-like members of the hinge are foldable.

22. Apparatus according to claim 17 including a volute spring in the housing below the capsule, the volute spring having an axis along which it can be compressed, the lamp contact being aligned with said axis and being in spring-biased contact with the volute spring.

23. Apparatus according to claim 22 in which the hinge has opposite foldable legs that fold along opposite sides of the volute springs when the capsule is mounted in the housing.

* * * * *